United States Patent [19]

Marass

[11] Patent Number: 4,765,606

[45] Date of Patent: Aug. 23, 1988

[54] SHEET FEEDER

[75] Inventor: Josef Marass, Murnau-Seehausen, Fed. Rep. of Germany

[73] Assignee: Georg Spiess GmbH, Gersthofen, Fed. Rep. of Germany

[21] Appl. No.: 65,825

[22] Filed: Jun. 23, 1987

[30] Foreign Application Priority Data

Jul. 5, 1986 [DE] Fed. Rep. of Germany ..... 3622692

[51] Int. Cl.[4] ..... B65H 1/08

[52] U.S. Cl. ..... 271/157; 414/35

[58] Field of Search ..... 271/147, 157–159; 414/35, 118

[56] References Cited

U.S. PATENT DOCUMENTS 2,997,298 8/1961 Elliott ..... 271/159

4,195,959 4/1980 Schmitt ..... 414/35

*Primary Examiner*—Richard A. Schacher

*Attorney, Agent, or Firm*—Collard, Roe & Galgano

[57] ABSTRACT

In the context of a sheet feeder comprising a stack carrying table able to be moved by a lifting device and having front and side abutments, precise positioning of the stack is facilitated inasfar as the stack carrying table is composed of a supporting table adapted to be connected with a lifting member of the lifting device and of a loading stage supported on the carrying table for free movement in its own plane in substantially all directions within the plane. The sheet feeder furthermore has a clamping device which is able to detachably clamp the stage to the supporting table.

14 Claims, 1 Drawing Sheet

A
A

SHEET FEEDER

BACKGROUND OF THE INVENTION

The invention relates to a sheet feeder comprising a stack carrying table to be moved by a lifting device and front and side stack abutments associated with the stack table.

In sheet feeders of conventional design the stack table is in the form of a simple platform and in such arrangements it is very difficult to move a stack of sheets onto the stack table by means of a pallet truck so that the stack engages the lateral and front abutments. As a rule, a whole series of maneuvers is required before the stack comes into engagement and this wastes time and labor.

Even so, it is not possible to avoid innaccuate alignment with the result that the sheets are not satisfactorily engaged by the moving feed elements of the machine processing the sheets.

SHORT SUMMARY OF THE INVENTION

In view of this state of the art one object of the present invention is to devise a sheet feeder of the type initially mentioned which makes possible an accurate positioning of the stack.

A still further aim of the invention is to design such a sheet feeder which only needs simple design adaptions in order to fulfill this object of precise positioning.

In order to achieve these or other objects appearing in the course of the present specification and claims, the stack carrying table includes a supporting table, which is connected with the lifting elements of the lifting means, and a loading stage or ramp thereon which may be displaced in all directions in plane-parallelism and which is able to be locked to the supporting table by means of a clamping device.

These features mean in effect that the loading stage is supported in a floating manner on the carrying table. This thus makes it possible, after the stack of sheets has been moved to and placed on the loading stage using a pallet truck, for the stack to be brought into engagement with the front and lateral stack abutments simply by displacing the loading stage in relation to the lifting table carried on the lifting means. There is no longer any need for a slow and awkward maneuvering of the pallet truck to get the stack into the required position. The features of the invention thus guarantee a substantial simplification of handling and at the same time they accelerate set-up operations. Nevertheless it is possible to obtain a high degree of accuracy as regards the desired positioning of the stack and also a highly precise engagement.

As part of a convenient further feature of the invention the loading stage and preferably the supporting table may be in the form of solid slab. The use of a solid slab to constitute the loading stage leads to the useful effect that it pallet truck may then be readily driven onto it without the possibility of damage. Since the lifting table is in the form of a slab as well, there is the advantage of having a support for the loading stage over its full surface and of a generally rigid and strong construction.

A further feature of the invention may also be adopted in accordance with which the loading stage is shorter than the supporting table at least in the direction athwart the median longitudinal plane of the feeder.

This serves to prevent the lifting chains of the lifting means or the like from fouling the loading stage.

In accordance with a further advantageous feature of the invention the clamping means has at least one, and more particularly two, eccentric members which are preferably operated by means of a pedal and are respectively pivoted on a ledge projecting past the rear edge of the supporting table, each such eccentric member cooperating with a clamping pad attached to loading stage so as to fit under it. This design leads to a simple structure of the clamping means and enables it to be simply operated. Since the clamping pad of the loading stage has the ledge of the lifting table fitting under it there is the advantage that the clamping pad on the loading stage is supported so that it may be designed in the form of a simple bar.

As part of a more especially preferred feature of the invention the loading stage may be bearinged by means of bearing balls contained in a plane-parallel cage, preferably fashioned of plastic on the supporting table. This bearing arrangement of the balls in a cage ensures an even distribution of the balls over the area of the loading stage and thus a even supporting action for the loading stage over its full surface. The use of a plastic slab or plate for forming the cage housing the balls means that the system is still able to move under extreme conditions, and it is possible to do without lubrication.

The mobility of the loading stage in relation to the supporting table may be limited in accordance with a further development of the invention by the provision of abutments which are preferably each in the form of an abutment pin fitting into a recess having a large area. The use of terminal abutments makes the system very reliable. The design of the recesses for the abutment pins to as to have a large area ensures thet the loading stage may be moved in all directions as desired.

It is convenient if the slab forming the cage for the balls is provided with at least two recesses and if the supporting table and the loading stage are each provided with at least one abutment pin in each case. Since then the abutment pins fit into the associated recess of the cage, which is also able to be displaced with the loading stage but only half as far, it is possible to make sure that even if the structure is designed with a small size, there is a comparatively large degree of mobility. Furthermore in this case there is the advantage of an over- or underlap between the laoding stage and the lifting table and thus an efficient utilisation of the space available. It is an advantage if the recesses for the abutment pins are in a rectangular, and more especially square, configuration.

Further convenient developments will be seen from the ensuing detailed account of one working example of the invention with reference to the drawings.

LIST OF THE SEVERAL FIGURES OF THE DRAWINGS

DETAILED ACCOUNT OF EMBODIMENT OF THE INVENTION

Figures 1, 2, 3, 4, 5:
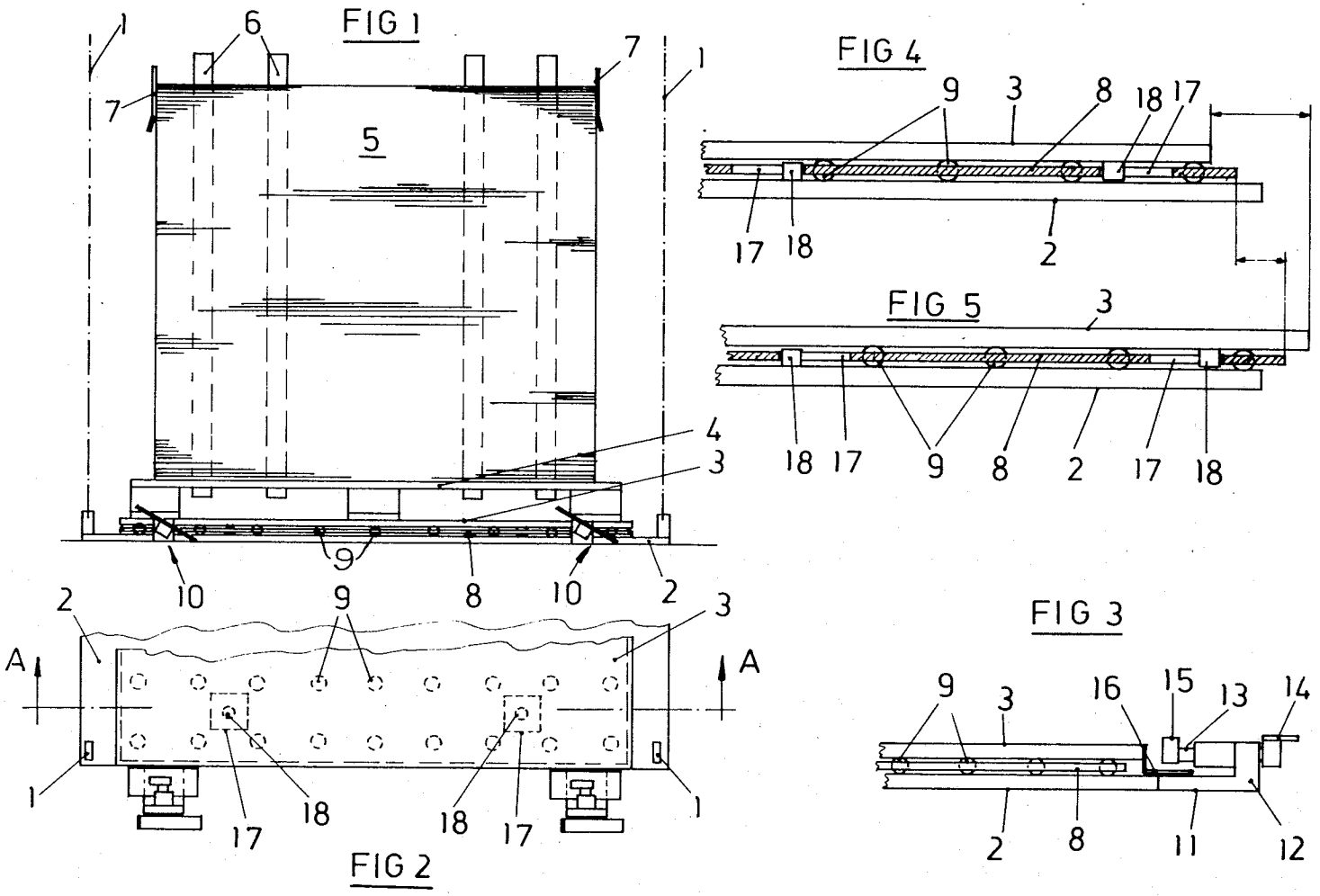
FIG. 1 is a view of part of the sheet feeder in accordance with the present invention in the form a stack carrying table loaded with a stack of sheets.
FIG. 2 is a plan view in part of the arrangement in accordance with FIG. 1.
FIG. 3 is a partial side view of the arrangement of FIG. 1.
FIG. 4 and 5 are sections taken on line A/A of FIG. 2 with the loading stage in its terminal positions.

The general structure and operation of a sheet feeder being familiar, no detailed account is given thereof. The stack carrying table to be seen in FIGS. 1 through 5 is made up of a lifting table 2, which is carried on a lifting means only indicated by its lifting chains in figure, and a loading stage 3 which is carried on the table so as to able to moved in plane-parallelism thereto in all directions, that is to say in all directions in the given plane. In the state of operation indicated in FIG. 1 a pallet 4 with a stack 5 of sheets thereon is rested on the loading stage. The sheet stack 5 is so placed that is front edge abuts the front abutments formed by upright rails and its side edges are between two adjustable side abutments 7. The lifting means 1 and the front and side abutments 6 and 7 are mounted on a frame which is not indicated in detail and also carries a reciprocating suction head for taking up and pulling over the respectively uppermost sheet in the pile.

For loading the loading stage 3 the pallet 4 bearing the stack 5 is placed on the lifting form of a lift truck and moved by the lift truck to the loading stage 3 and deposited thereon. In order to ensure that the loading stage is fully able to bear the weight of the wheels of the lifting truck without denting it is made in the form of a soild slab and in the particular embodiment of the invention envisaged the lifting table 2 is made in the form of a solid slab as well so that there is a simple construction in which the loading stage 3 is supported over a large area. However, it would also be possible for the lifting table and/or the loading stage 3 to be made in the form of a frame-like platform.

The exact location of the stack 5 of sheet in relation to the front abutments 6 and the lateral abutments 7 is carried out by displacing the loading stage 3, which is supported so that it is able to be moved to all sides in relation to the lifting table 2. The means supporting the loading stage 3 on the lifting table 2 may be in the form of a sliding as opposed to an anti-friction or rolling bearing system, for example by having the slab-like loading stage 3 resting directly on the slab-like lifting table 2. In the illustrated working example of the invention there is a bearing ball system in order to ensure free running. This system consists of balls 9 arranged in a cage 8, which is formed by a resin slab provided with openings for the balls and arranged in plan-parallelism between the lifting table 2 and the loading stage 3. The thickness of the resin slab is somewhat less than the diameter of the balls. The openings for the balls 9 are evenly distributed over the area of the slab forming the cage 8 and are in consequence arranged evenly over the area of the lifting table 2 and of the loading stage 3 so that there is an even supporting action over the full surface. After the stack 5 of sheets has been located by sliding the loading stage 3 into the desired position generally indicated in FIG. 1, the loading stage 3 is locked in relation to the lifting table 2 by means of a clamping system generally referenced 10 in FIG. 1. This locking or clamping system 10, see FIGS. 2 and 3, is formed by two ledges 11 on the rear edge of the lifting table 2 placed so that they project beyond the rear edge of the table. At their rear end the ledges 11 have a plain bearing mount 12 in which a shaft 13 is carried which at its rear end has a pedal 14 and at its front end (which is over the ledge 11) has an eccentric member 15, which by operation of the pedal 14 to turn the shaft may be brought into clamping engagement with a clamping pad 16, which is secured to the loading stage 3 to fit under same and which is placed over the ledge 11. In the present case the clamping pad is in the form of a simple angle member. In place of the pedal operating system as illustrated herein it would also be possible to have operation by means of cylinder and piston actuator.

The movement of the loading stage 3 in relation tot he lifting table 2 is limited by means of abutments. For this purpose the lifting table 2 may be provided with a surrounding arrangement of abutment rails, against which the loading stage will move, it making engagement at its edge which is smaller in accordance with the degree of possible motion. In the illustrated working example, as will be gathered from the FIGS. 2, 4 and 5, the resin slab forming the cage 8 is provided with two or more square openings 17, into which there are respectively fitted pins 18 attached to the lifting table and to the loading stage 3 respectively, the pins on the lifting table 2 extending downwards into the openings 17 and those on the loading stage 3 extending upwards thereinto. The pins 18 are, as will best be seen from FIG. 2, so arranged that in the central position of the loading stage 3 near the center of the area they are in the respective recess or opening 17. In the design of FIGS. 1 and 2 the breadth of the loading stage is inferior to the breadth of the lifting table. This may also apply for the length. Since however the slab forming the cage 8 the recess 17 for the abutment pins 18 is also moved when the loading stage 3 moves but half as far as it, the length and the breadth of the recesses for the abutment pins 18 may be suitably reduced to be less than the full stroke of the loading stage 3 as required for making full use of the area of the lifting table 2. The recesses 17 may therefore readily be placed between the balls 9. In the working example of the invention illustrated in FIGS. 1 and 2 the distance by which the breadth of the loading stage 3 is less than the breadth of the lifting table 2 is in the order to the maximum stroke of the loading stage 3. The length and breadth of the recesses 17 is generally equal to half the maximum displacement or stroke of the loading stage 3. In the lateral terminal positions the edges of the lifting table 2 and the loading stage 3 are generally aligned with each other. It is possible for the design to be similar in the length direction. In the illustrated working example of the invention the length of the lifting table 2 and of the loading stage 3 are to be equal so that in the terminal positions, as indicated in FIGS. 4 and 5, there is a mutual under- and overlap.

What is claimed is:

1. A sheet feeder comprising a stack carrying table able to be moved by a lifting device and having front and side abutments, said stack carrying table being composed of a supporting table adapted to be connected with a lifting member of the lifting device and of a loading stage supported on the carrying table for free movement in its own plane in substantially all directions within said plane, said sheet feeder furthermore comprising a clamping device which is able to detachably clamp said stage to said supporting table.

2. The sheet feeder as claimed in claim 1 wherein said stage is in the form of a platform.

3. The sheet feeder as claimed in claim 1 wherein said carrying table is in the form of a platform.

4. The sheet feeder as claimed in claim 1 wherein said stage and said carrying table are in the form of solid slabs.

5. The sheet feeder as claimed in claim 1 wherein, at least in a direction athwart a median longitudinal plane of the feeder, the stage is shorter than the supporting table.

6. The sheet feeder as claimed in claim 1 wherein said clamping device comprises a ledge projecting past on a rear edge of the supporting table, at least one eccentric member mounted rotatably on the ledge, and a clmaping pad underlapping the stage on which it is mounted.

7. The sheet feeder as claimed in claim 6 comprising pedal means for operation of each eccentric member.

8. The sheet feeder as claimed in claim 1 comprising a cage and balls mounted therein, said cage being in the form of a planar body so that said balls movingly support said stage on said supporting table.

9. The sheet feeder as claimed in claim 8 wherein said cage is in the form of resin slab having openings therein for said balls.

10. The sheet feeder as claimed in claim 1 comprising abutment means for limiting motion of the stage in relation to the supporting table 11. The sheet feeder as claimed in claim 10 wherein said abutment means includes pins respectively fitting into recesses with a large area.

12. The sheet feeder as claimed in claim 9 wherein said slab forming said cage is provided with at least two recesses for respective abutment pins and said supporting table and the stages are each provided with at least one abutment pin.

13. The sheet feeder as claimed in claim 12 wherein said recesses associated with said abutment pins have a rectangular form.

14. The sheet feeder as claimed in claim 13 wherein said recesses associated with said abutment pins have a square form.

* * * * *